US007744484B1

(12) United States Patent
Chao

(10) Patent No.: US 7,744,484 B1
(45) Date of Patent: Jun. 29, 2010

(54) MOVABLE WEIGHTS FOR A GOLF CLUB HEAD

(75) Inventor: Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 846 days.

(21) Appl. No.: 11/524,031

(22) Filed: Sep. 19, 2006

Related U.S. Application Data

(63) Continuation-in-part of application No. 10/785,692, filed on Feb. 23, 2004, now Pat. No. 7,166,040, which is a continuation-in-part of application No. 10/290,817, filed on Nov. 8, 2002, now Pat. No. 6,773,360.

(51) Int. Cl.
*A63B 53/04* (2006.01)
*A63B 53/06* (2006.01)

(52) U.S. Cl. ..... 473/324; 473/334; 473/338; 473/345; 473/409

(58) Field of Classification Search ..... 473/324–350, 473/287–292, 409; D21/789
See application file for complete search history.

(56) References Cited

U.S. PATENT DOCUMENTS

| | | | | |
|---|---|---|---|---|
| 1,133,129 | A | 3/1915 | Govan | |
| 1,518,316 | A | 12/1924 | Ellingham | |
| 1,526,438 | A | 2/1925 | Scott | |
| 1,538,312 | A | 5/1925 | Beat | |
| 1,704,119 | A | 3/1929 | Buhrke | |
| 1,970,409 | A | 8/1934 | Wiedemann | |
| D107,007 | S | 11/1937 | Cashmore | |
| 2,163,091 | A * | 6/1939 | Held | 473/338 |
| 2,198,981 | A * | 4/1940 | Sullivan | 473/338 |
| 2,214,356 | A | 9/1940 | Wettlaufer | |
| 2,225,930 | A | 12/1940 | Sexton | |
| 2,360,364 | A | 10/1944 | Reach | |
| 3,064,980 | A | 11/1962 | Steiner | |
| 3,466,047 | A | 9/1969 | Rodia et al. | |
| 3,556,533 | A | 1/1971 | Hollis | |
| 3,589,731 | A | 6/1971 | Chancellor | |
| 3,606,327 | A | 9/1971 | Gorman | |

(Continued)

FOREIGN PATENT DOCUMENTS

| | | |
|---|---|---|
| DE | 9012884 | 9/1990 |

(Continued)

OTHER PUBLICATIONS

Office Action from the U.S. Patent and Trademark Office in co-pending U.S. Appl. No. 11/066,720, dated Apr. 2, 2007.

(Continued)

*Primary Examiner*—Sebastiano Passaniti
(74) *Attorney, Agent, or Firm*—Klarquist Sparkman, LLP

(57) ABSTRACT

Embodiments of movable weights, such as weight plugs and other types of movable weights, for a golf club head are disclosed herein. One embodiment for a weight plug, for example, includes a mass element with a first end that has a threaded portion and a second end. The weight plug also has a weight cap with a seal retention portion that is configured to engage a seal. The cap is also configured to engage the threaded portion of the mass element. A seal is positioned between the first end of the mass element and the seal retention portion of the cap.

19 Claims, 8 Drawing Sheets

U.S. PATENT DOCUMENTS 3,610,630 A 10/1971 Glover
3,652,094 A 3/1972 Glover
3,672,419 A 6/1972 Fischer
3,692,306 A 9/1972 Glover
3,743,297 A 7/1973 Dennis
3,897,066 A 7/1975 Belmont
3,976,299 A 8/1976 Lawrence et al.
3,979,122 A 9/1976 Belmont
3,979,123 A 9/1976 Belmont
4,008,896 A 2/1977 Gordos
4,043,563 A 8/1977 Churchward
4,052,075 A * 10/1977 Daly ..... 473/338
4,076,254 A 2/1978 Nygren
4,085,934 A 4/1978 Churchward
4,121,832 A 10/1978 Ebbing
4,262,562 A 4/1981 MacNeill
D259,698 S 6/1981 MacNeill
4,340,229 A 7/1982 Stuff, Jr.
4,411,430 A 10/1983 Dian
4,423,874 A 1/1984 Stuff, Jr.
4,530,505 A 7/1985 Stuff
D284,346 S 6/1986 Masters
4,607,846 A 8/1986 Perkins
4,695,054 A * 9/1987 Tunstall ..... 473/338
4,730,830 A 3/1988 Tilley
4,754,977 A 7/1988 Sahm
4,795,159 A 1/1989 Nagamoto
4,869,507 A 9/1989 Sahm
4,895,371 A 1/1990 Bushner
4,962,932 A 10/1990 Anderson
5,039,267 A 8/1991 Wollar
5,050,879 A 9/1991 Sun et al.
5,058,895 A 10/1991 Igarashi
5,244,210 A 9/1993 Au
5,253,869 A 10/1993 Dingle et al.
D343,558 S 1/1994 Latraverse et al.
5,316,305 A 5/1994 McCabe
5,320,005 A 6/1994 Hsiao
5,385,348 A 1/1995 Wargo
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
5,518,243 A 5/1996 Redman
5,533,730 A 7/1996 Ruvang
5,571,053 A 11/1996 Lane
5,629,475 A 5/1997 Chastonay
5,632,694 A 5/1997 Lee
5,683,309 A 11/1997 Reimers
5,709,613 A 1/1998 Sheraw
D392,526 S 3/1998 Nicely
5,746,664 A 5/1998 Reynolds, Jr.
5,769,737 A 6/1998 Holladay et al.
5,776,011 A 7/1998 Su et al.
D409,463 S 5/1999 McMullin
5,911,638 A 6/1999 Parente et al.
D412,547 S 8/1999 Fong
5,935,019 A 8/1999 Yamamoto
5,947,840 A 9/1999 Ryan
5,967,905 A 10/1999 Nakahara et al.
5,997,415 A 12/1999 Wood
6,015,354 A 1/2000 Ahn et al.
6,019,686 A 2/2000 Gray
6,023,891 A 2/2000 Robertson et al.
6,032,677 A 3/2000 Blechman et al.
6,033,321 A * 3/2000 Yamamoto ..... 473/338
6,056,649 A 5/2000 Imai
6,089,994 A 7/2000 Sun
6,149,533 A 11/2000 Finn
6,162,132 A 12/2000 Yoneyama
6,238,303 B1 5/2001 Fite
6,270,422 B1 8/2001 Fisher
6,277,032 B1 8/2001 Smith
6,296,579 B1 10/2001 Robinson
6,348,014 B1 2/2002 Chiu
6,379,265 B1 4/2002 Hirakawa et al.
6,409,612 B1 6/2002 Evans et al.
6,436,142 B1 8/2002 Paes et al.
6,440,009 B1 8/2002 Guibaud et al.
6,514,154 B1 2/2003 Finn
6,517,447 B2 * 2/2003 Buchanan ..... 473/282
6,524,197 B2 2/2003 Boone
6,527,649 B1 3/2003 Neher et al.
6,530,848 B2 3/2003 Gillig
6,565,448 B2 5/2003 Cameron et al.
6,641,487 B1 11/2003 Hamburger
6,739,983 B2 5/2004 Helmstetter et al.
6,757,572 B1 6/2004 Forest
6,773,360 B2 8/2004 Willett et al.
6,860,818 B2 3/2005 Mahaffey et al.
6,974,393 B2 12/2005 Caldwell et al.
6,988,960 B2 1/2006 Mahaffey et al.
6,991,558 B2 1/2006 Beach et al.
7,140,974 B2 11/2006 Chao et al.
7,153,220 B2 12/2006 Lo
7,163,468 B2 1/2007 Gibbs et al.
7,166,040 B2 1/2007 Hoffman et al.
7,169,060 B2 1/2007 Stevens et al.
7,186,190 B1 3/2007 Beach et al.
7,189,169 B2 * 3/2007 Billings ..... 473/332
7,223,180 B2 * 5/2007 Willett et al. ..... 473/334
7,572,194 B2 * 8/2009 Yamamoto ..... 473/334
2001/0049310 A1 12/2001 Cheng et al.
2002/0032075 A1 3/2002 Vatsvog
2002/0137576 A1 9/2002 Dammen
2002/0160854 A1 10/2002 Beach et al.
2003/0130059 A1 7/2003 Billings
2004/0242343 A1 12/2004 Chao
2006/0058112 A1 3/2006 Haralason et al.

FOREIGN PATENT DOCUMENTS

EP 1001175 5/2000
GB 194823 12/1921
JP 06-126004 5/1994
JP 6304271 11/1994
JP 09-028844 2/1997
JP 9308717 12/1997
JP 10-234902 8/1998
JP 10277187 A 10/1998
JP 2004 222911 A 8/2004
WO WO 88/02642 4/1988
WO WO 01/66199 9/2001
WO WO 02/062501 8/2002
WO WO 03/061773 7/2003

OTHER PUBLICATIONS

Office Action from the U.S. Patent and Trademark Office in co-pending U.S. Appl. No. 11/066,720, dated Aug. 15, 2007.

* cited by examiner

MOVABLE WEIGHTS FOR A GOLF CLUB HEAD

CROSS REFERENCE TO RELATED APPLICATIONS

The present application is a continuation-in-part of U.S. patent application Ser. No. 10/785,692, filed Feb. 23, 2004, now U.S. Pat. No. 7,166,040, which is a continuation-in-part of U.S. patent application Ser. No. 10/290,817, filed on Nov. 8, 2002 now U.S. Pat. No. 6,773,360. These applications are incorporated herein by this reference.

FIELD

The present application is directed to weights for a golf club head, particularly movable weights for a golf club head.

BACKGROUND

The center of gravity (CG) of a golf club head is one critical parameter of the club's performance. Upon impact, the position of the CG greatly affects launch angle and flight trajectory of a struck golf ball. Thus, much effort has been made over positioning the center of gravity of golf club heads. To that end, current driver and fairway wood golf club heads are typically formed of lightweight, yet durable materials, such as steel or titanium alloys. These materials are typically used to form thin club head walls. Thinner walls are lighter, and thus result in greater discretionary weight, i.e., weight available for redistribution around a golf club head. Greater discretionary weight allows golf club manufacturers more leeway in assigning club mass to achieve desired golf club head mass distributions.

Various approaches have been implemented for positioning discretionary mass about a golf club head. Many club heads have integral sole weight pads cast into the head at predetermined locations to lower the club head's center of gravity. Also, epoxy may be added to the interior of the club head through the club head's hosel opening to obtain a final desired weight of the club head. To achieve significant localized mass, weights formed of high-density materials have been attached to the sole. With these weights, the method of installation is critical because the club head endures significant loads at impact with a golf ball, which can dislodge the weight. Thus, such weights are usually permanently attached to the club head and are limited in total mass. This, of course, permanently fixes the club head's center of gravity.

Golf swings vary among golfers, but the total weight and center of gravity location for a given club head is typically set for a standard, or ideal, swing type. Thus, even though the weight may be too light or too heavy, or the center of gravity is too far forward or too far rearward, the golfer cannot adjust or customize the club weighting to his or her particular swing. Rather, golfers often must test a number of different types and/or brands of golf clubs to find one that is suited for them. This approach may not provide a golf club with an optimum weight and center of gravity and certainly would eliminate the possibility of altering the performance of a single golf club from one configuration to another and then back again.

It should, therefore, be appreciated that there is a need for a system for adjustably weighting a golf club head that allows a golfer to fine-tune the club head to accommodate his or her swing. The present application fulfills this need and others.

SUMMARY

Disclosed below are representative embodiments that are not intended to be limiting in any way. Instead, the present disclosure is directed toward novel and nonobvious features, aspects and equivalents of the embodiments of the movable weights for a golf club head described below. The disclosed features and aspects of the embodiments can be used alone or in various novel and nonobvious combinations and sub-combinations with one another One of the disclosed movable weights embodiments is for a weight plug for a golf club head. For example, a weight plug of this embodiment includes a mass element with a first end that has a threaded portion and a second end. The weight plug also has a weight cap with a seal retention portion that is configured to engage a seal. A seal is positioned between the first end of the mass element and the seal retention portion of the cap. The cap is also configured to engage the threaded portion of the mass element to removably secure the mass element, seal and cap to the golf club head.

In some implementations, the cap can have an outer end, an inner end and a surface that tapers in a direction from the outer end to the inner end. The tapering surface can apply a radially outward directed pressure on the seal when the cap is moved closer to the mass element. The tapering surface can have a first end that has a first diameter and a second end that has a second diameter smaller than the first diameter. In some implementations, the seal retention portion includes an upper lip that has a diameter approximately equal to a recess diameter of the golf club head. The upper lip can be configured to restrict deformation of the seal in the axial direction as the weight cap engages the mass element. In some implementations, the weight cap may include an outer major surface that is substantially flush with an outer surface of the golf club head when the weight plug is secured in a recess formed in the golf club head. The outer major surface can have a socket configured for engagement with a tool for securing the weight plug in the golf club head. In one implementation, the cap can be tightened against the mass element such that the seal provides resistance to water entering the golf club head.

In some implementations, the cap and mass element may be shaped to cause the seal to deform in a radially outward direction when the cap is moved closer to the mass element. The deformation of the seal can assist in retaining the weight plug in the recess formed in the golf club head. Furthermore, the deforming seal can apply a radially outward directed pressure on a recess formed in the golf club thereby retaining the movable weight plug in the recess. The seal can be deformable into a groove formed in an inner wall of the recess and can have an inner diameter smaller than the first diameter of the tapered section when the seal is in an undeformed state.

In some implementations, the second end of the mass element is sized to extend into a recess formed in the golf club head. The mass element may also include a first end comprising a lip configured to engage a portion of the recess to restrict the first end from passing through the recess such that the first end rests at least partially within the recess. The mass element can include at least one retention tab configured to engage a corresponding retention hole formed in the recess of the golf club. The at least one retention tab can restrict rotation of the weight plug while secured in the recess.

One disclosed method of securing a movable weight plug in a recess formed in a golf club head includes inserting a mass element that has a first end with a threaded portion and a second end into the recess such that the second end extends through the recess and the first end rests at least partially within the recess. The method further includes positioning a seal within the recess such that the seal rests on the first end of the mass element. The method can also include threadably engaging the mass element with a weight cap configured to engage the threaded portion of the mass element such that a seal retention portion formed in the weight cap urges the seal radially outward to frictionally engage an adjacent surface of the recess.

In some methods, threadably engaging the mass element with the weight cap causes the seal to deform in the radially outward direction. In some methods, the surface of the recess may include a groove and threadably engaging includes urging the seal radially outward to frictionally engage the groove in the adjacent surface of the recess. In other methods, threadably engaging comprises tightening the weight cap against the mass element such that an outer surface of the weight cap is substantially flush with an outer surface of the golf club head.

In some methods, the mass element may include at least one tab proximate its first end and the recess may include at least one corresponding tab receiving hole. In these methods, inserting the mass element can include inserting the at least one tab into the at least one corresponding tab receiving hole. In still other methods, the recess can include a mass element receiving ledge and the mass element can include a support rim extending circumferentially around the first end of the mass element. In these methods, inserting the mass element can include resting the support rim on the mass element receiving ledge. In other methods, the weight cap can include an outer major surface having a socket configured for engagement with a tool for securing the weight plug in the recess of the golf club head. In these methods, threadably engaging may include tightening the weight cap against the mass element by engaging the socket with the tool.

One of the disclosed embodiments is for a golf club head. For example, a golf club head of this embodiment can include at least one recess formed in the golf club head. The golf club head can also include at least one weight plug positionable within the at least one recess. The weight plug can include a mass element that has a mass and a length with a first end having a threaded portion and a second end extendable into and through the at least one recess, a seal positionable adjacent the first end of the mass element, and a cap with a seal retention portion configured to engage the seal. The cap can be further configured to engage the threaded portion of the mass element. In this embodiment, tightening the cap to the mass element removably secures the weight plug at least partially within the at least one recess.

In some implementations, the mass element is a first mass element with a first mass and a first length. The first mass element can be replaceable by a second mass element having a second mass different from the first mass and a second length different from the first length without altering the at least one recess, seal, or cap.

Another of the disclosed movable weights embodiments is for a weight plug for insertion into a recess formed in a golf club head. For example, a weight plug of this embodiment includes a mass element having a non-circular cross-section that is sized to extend through an outer opening and an inner opening formed in the recess. The outer opening of the recess has a generally circular shape and the inner opening has a generally non-circular shape defined by a projecting wall and an area smaller than the outer opening. The mass element non-circular cross-section generally corresponds with the generally non-circular shape of the inner opening. This embodiment also includes a cap threadably coupleable to the mass element. A portion of the cap is sized to rest within the outer opening formed in the recess and to not pass through the inner opening of the recess. In the embodiment, at least a portion of the projecting wall is secured between the mass element and the cap as the mass element and the cap are assembled together and tightened.

In some implementations, the weight plug can have at least one stop coupled to the recess where the stop limits rotation of the mass element to facilitate rotation of the cap relative to the mass element. In several implementations, the cap can include an outer major surface having a socket configured for engagement with a tool for securing the weight plug in the golf club head. In other implementations, the portion of the cap sized to rest within the outer opening includes an outermost diameter approximately equal to a diameter of the outer opening of the recess. In yet other implementations, the mass element cross-section includes a generally elliptical shape and the inner opening has a corresponding generally elliptical shape. In some implementations, the mass element can apply an outward directed pressure to the projecting wall and the cap can apply an opposing inward directed pressure to the projecting wall.

Another disclosed method of securing a movable weight plug in a recess formed in a golf club head includes providing a movable weight plug that includes a mass element that has a non-circular cross-section sized to extend through an outer opening and an inner opening formed in the recess. The outer opening of the recess has a generally circular shape and the inner opening has a generally non-circular shape and an area smaller than the outer opening. The weight plug further includes a cap threadably coupled to the mass element where a portion of the cap is sized to rest within the outer opening of the recess and to not pass through the inner opening formed in the recess. The method also includes inserting the movable weight plug into the recess such that the mass element extends into and beyond the outer opening and the inner opening formed in the recess. In this method, at least a portion of the cap extends into and rests within the outer opening of the recess. The method also includes rotating the mass element such that a portion of a sidewall defining the recess is positioned between the mass element and the cap. The method further includes tightening the cap to the mass element such that the mass element applies an outward directed pressure to the portion of the recess between the mass element and the cap and the cap applies an inward directed pressure to the portion of the recess between the mass element and the cap such that the portion of the recess is secured between the mass element and the cap.

In some methods, the recess can include a stop. In these methods, rotating may include rotating the mass element in a tightening direction until a portion of the mass element contacts the stop to prevent further rotation of the mass element in the tightening direction. Tightening can include rotating the cap in the tightening direction relative to the mass element as the mass element is prevented from further rotation in the tightening direction by the stop.

In some methods, the mass element cross-section and the inner opening non-circular shape can be generally elliptically shaped. In these methods, inserting includes extending the generally elliptically shaped mass element into and beyond the generally elliptically shaped inner opening of the recess. In other methods, the cap can include an outer end having a recess formed therein for engagement with a tool for securing the weight plug in the golf club head. In these methods, tightening can include rotating the cap relative to the mass element using the tool.

One of the disclosed embodiments is for a golf club head. For example, a golf club head of this embodiment can include at least one recess formed in the golf club head. The recess includes an outer opening that has a generally circular shape, an inner opening smaller in area than the outer opening that has a generally non-circular shape, and a shoulder between the outer opening and the inner opening. The golf club head of this embodiment can also include a movable weight plug positionable within the recess that includes a mass element and a cap. The mass element includes a non-circular cross-section sized to extend through the outer opening and the inner opening of the recess and the cap can be rotatably coupled to the mass element. In this embodiment, a portion of the cap is sized to rest within the outer opening formed in the recess and to not pass through the inner opening formed in the recess and a portion of the shoulder is secured between the mass element and the cap as the cap is tightened to the mass element.

In some implementations, the golf club head may include a mass element where the cross-section includes a generally elliptical shape and the inner opening has a corresponding generally elliptical shape. In other implementations, the mass element is a first mass element that has a first mass and a first length. In this implementation, the first mass element can be replaceable by a second mass element that has a second mass different from the first mass and a second length different from the first length without altering the at least one recess or the cap.

The foregoing and other features and advantages of the disclosed embodiments will become more apparent from the following detailed description, which proceeds with reference to the accompanying figures.

DETAILED DESCRIPTION

Disclosed below are representative embodiments that are not intended to be limiting in any way. Instead, the present disclosure is directed toward novel and nonobvious features, aspects and equivalents of the embodiments of the golf club information system described below. The disclosed features and aspects of the embodiments can be used alone or in various novel and nonobvious combinations and sub-combinations with one another.

Figure 1:
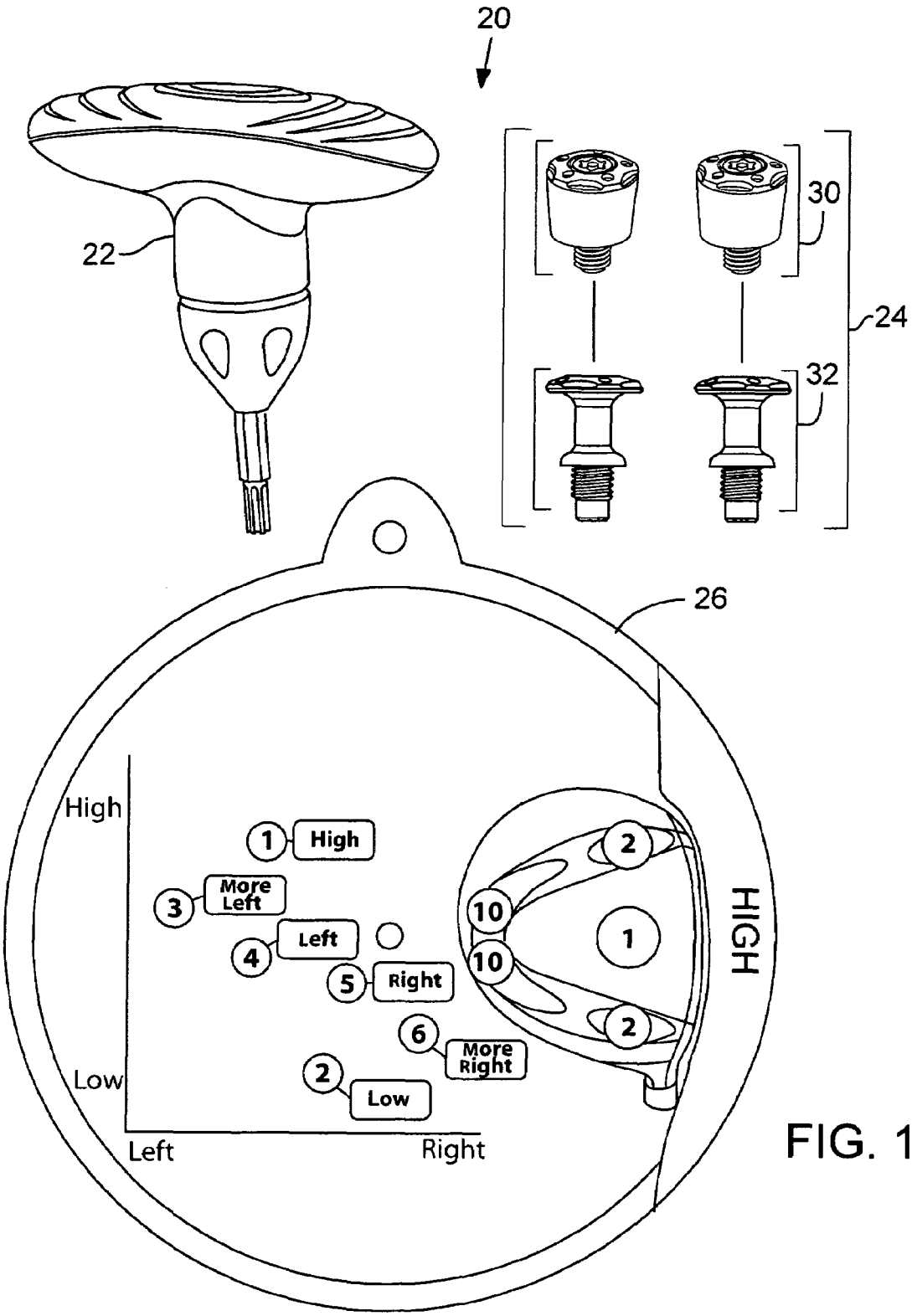
FIG. 1 is a perspective view of an embodiment of a kit for adjustably weighting a golf club head in accordance with the invention.

Now with reference to the illustrative drawing, and particularly FIG. 1, there is shown a kit 20 having a driving tool, i.e., torque wrench 22, and a set of weights 24 usable with a golf club head having conforming recesses and an instruction wheel 26.

An exemplary club head 28 includes four recesses, e.g., weight ports 96, 98, 102, 104, disposed about the periphery of the club head 28 (FIGS. 2-5). In the exemplary embodiment, four weights 24 are provided: two weight assemblies 30 of about ten grams and two weight screws 32 of about two grams. Although the exemplary embodiment includes four weights 24, two of which are weight assemblies 30 and two of which are weight screws 32, "weights" as used herein, can refer to any number of weights 24, including one or more weight assemblies 30, or one or more weight screws 32, or any combination thereof. In most embodiments, there is one of the weights for each of the weight ports 96, 98, 102, 104.

Varying placement of the weights within weight ports 96, 98, 102 and 104 enables the golfer to vary launch conditions of a golf ball struck by the club head 28, for optimum distance and accuracy. More specifically, the golfer can adjust the position of the club head's center of gravity (CG), for greater control over the characteristics of launch conditions and, therefore, the trajectory and shot shape of a struck golf ball.

With reference to FIGS. 1-5, the weights 24 are sized to be securely received in any of the four weight ports 96, 98, 102, 104 of the club head 28, and are secured in place using the torque wrench 22. The weight assemblies 30 preferably stay in place via a press fit. Weights 24 are configured to withstand forces at impact, while also being easy to remove. The instruction wheel 26 aids the golfer in selecting a proper weight configuration for achieving a desired effect to the trajectory and shape of the golf shot. In some embodiments, the kit 20 provides six different weight configurations for the club head 28, which provides substantial flexibility in positioning the CG of the club head 28. In the exemplary embodiment, the CG of the club head 28 can be adjustably located in an area adjacent to the sole having a length of about five millimeters measured from front-to-rear and width of about five millimeters measured from toe-to-heel. Each configuration delivers different launch conditions, including ball launch angle, spin-rate and the club head's alignment at impact, as discussed in detail below.

Each of the weight assemblies 30 (FIGS. 10-12) includes a mass element 34, a fastener, e.g., screw 36, and a retaining element 38. In the exemplary embodiment, the weight assemblies 30 are preassembled; however, component parts can be provided for assembly by the user.

Figure 9:
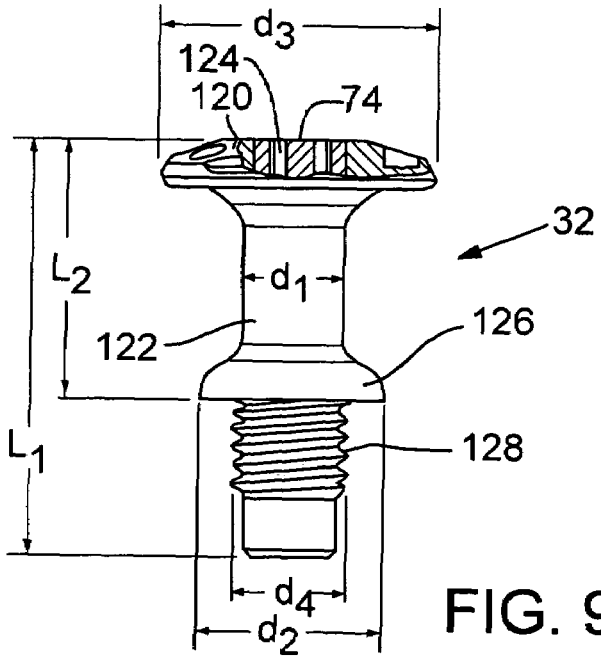
FIG. 9 is a side elevational view of a weight screw of the kit of FIG. 1.

For weights having a total mass between about one gram and about two grams, weights screws 32 without a mass element preferably are used (FIG. 9). The weight screws 32 can be made from any suitable material, including steel or titanium in some implementations and can have a head 120 with an outermost diameter sized to conform to any of the four weight ports 96, 98, 102, 104 of the club head 28.

The kit 20 can be provided with a golf club at purchase, or sold separately. For example, a golf club can be sold with the torque wrench 22, the instruction wheel 26, and the weights 24 (e.g., two 10-gram weight assemblies 30 and two 2-gram weight screws 32) preinstalled. Kits 20 having an even greater variety of weights can also be provided with the club, or sold separately. In another embodiment, a kit 20 having eight weights 24 is contemplated (e.g., a 2-gram weight screw 32, four 6-gram weight assemblies 30, two 14-gram weight assemblies 30, and an 18-gram weight assembly 30. Such a kit 20 may be particularly effective for golfers with a fairly consistent swing, by providing additional precision in weighting the club head 28. Also, weights in prescribed increments across a broad range can be available.

For example, weights 24 in one gram increments ranging from one gram to twenty-five grams can provide very precise weighting, which would be particularly advantageous for advanced and professional golfers. In some embodiments, the weight assembly has a mass between about 1 gram and about 25 grams. In more specific embodiments, the weight assembly has a mass between about 1 gram and about 5 grams, between about 5 grams and about 10 grams, between about 10 grams and about 15 grams or between about 15 grams and about 25 grams. In certain embodiments, weight assemblies 30 ranging between five grams and ten grams preferably use a mass element 34 comprising primarily a titanium alloy. Weight assemblies 30 ranging between ten grams to over twenty-five grams, preferably use a mass element 34 comprising a tungsten-based alloy, or blended tungsten alloys. The mass element 34 can be made from any other suitable material, including, but not limited to, brass, steel, titanium or combinations thereof, to achieve a desired weight mass. Furthermore, the mass element 34 can have a uniform or non-uniform density. The selection of material may also require consideration of other requirements such as durability, size restraints, and removability.

Instruction Wheel

Figure 6:
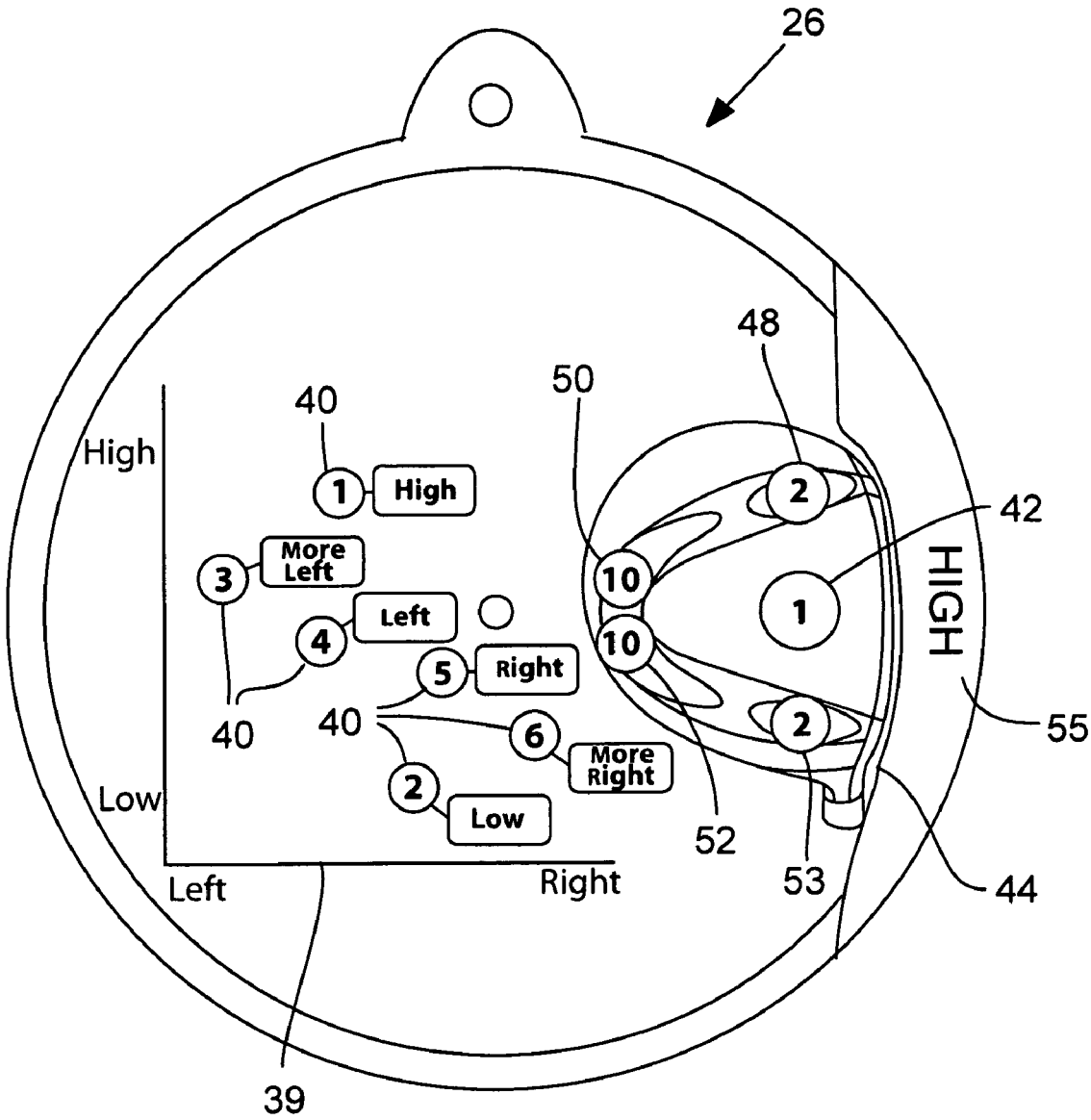
FIG. 6 is a plan view of the instruction wheel of the kit of FIG. 1.

With reference now to FIG. 6, the instruction wheel 26 aids the golfer in selecting a club head weight configuration to achieve a desired effect on the motion path of a golf ball struck by the golf club head 28. The instruction wheel 26 provides a graphic, in the form of a motion path chart 39 on the face of instruction wheel 26 to aid in this selection. The motion path chart's y-axis corresponds to the height control of the ball's trajectory, generally ranging from low to high. The x-axis of the motion path chart corresponds to the directional control of the ball's shot shape, ranging from left to right. In the exemplary embodiment, the motion path chart 39 identifies six different weight configurations 40. Each configuration is plotted as a point on the motion path chart 39. Of course, other embodiments can include a different number of configurations, such as, for kits having a different variety of weights. Also, other approaches for presenting instructions to the golfer can be used, for example, charts, tables, booklets, and so on. The six weight configurations of the exemplary embodiment are listed below in Table 1.

TABLE 1

| | | WeightDistribution | | | |
|---|---|---|---|---|---|
| Config. No. | Description | Fwd Toe | Rear Toe | Fwd Heel | Rear Heel |
| 1 | High | 2 g | 10 g | 2 g | 10 g |
| 2 | Low | 10 g | 2 g | 10 g | 2 g |
| 3 | More Left | 2 g | 2 g | 10 g | 10 g |
| 4 | Left | 2 g | 10 g | 10 g | 2 g |
| 5 | Right | 10 g | 2 g | 2 g | 10 g |
| 6 | More Right | 10 g | 10 g | 2 g | 2 g |

Each weight configuration (i.e., 1 through 6) corresponds to a particular effect on launch conditions and, therefore, a struck golf ball's motion path. In the first configuration, the club head CG is in a center-back location, resulting in a high launch angle and a relatively low spin-rate for optimal distance. In the second configuration, the club head CG is in a center-front location, resulting in a lower launch angle and lower spin-rate for optimal control. In the third configuration, the club head CG is positioned to induce a draw bias. The draw bias is even more pronounced with the fourth configuration. Whereas, in the fifth and sixth configurations, the club head CG is positioned to induce a fade bias, which is more pronounced in the sixth configuration.

Figure 2:
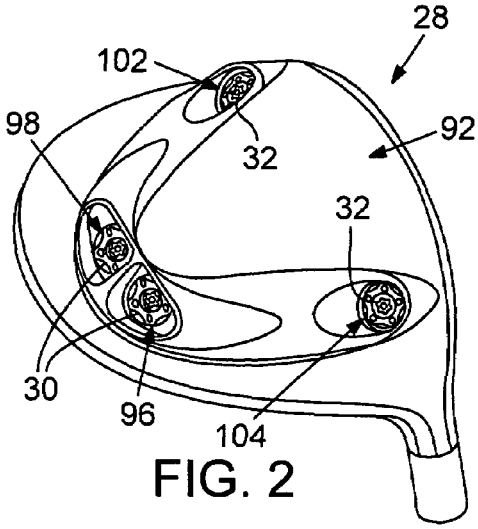
FIG. 2 is a bottom and rear side perspective view of a club head having four weight recesses.
Figure 3:
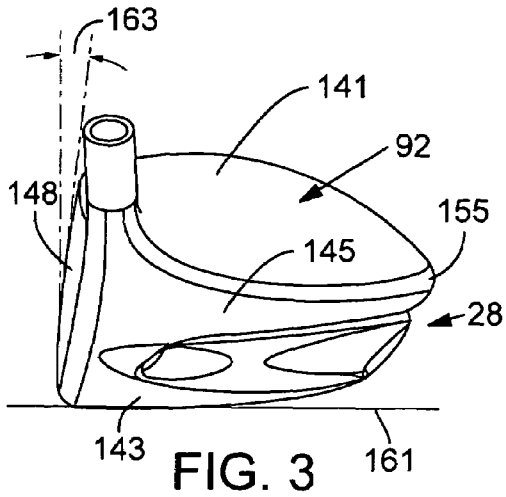
FIG. 3 is a side elevational view of the club head of FIG. 2, depicted from the heel side of the club head.
Figure 4:
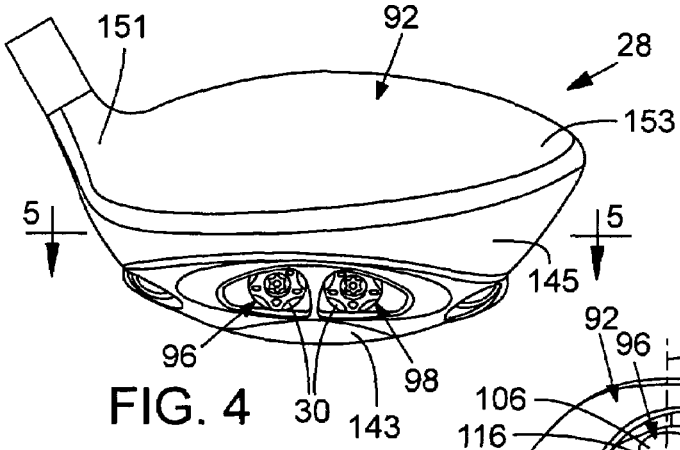
FIG. 4 is a rear elevational view of the club head of FIG. 2.

In use, the golfer selects, from the various motion path chart descriptions, the desired effect on the ball's motion path. For example, if hitting into high wind, the golfer may choose a golf ball motion path with a low trajectory, (e.g., the second configuration). Or, if the golfer has a tendency to hit the ball to the right of the intended target, the golfer may choose a weight configuration that encourages the ball's shot shape to the left (e.g., the third and fourth configurations). Once the configuration is selected, the golfer rotates the instruction wheel 26 until the desired configuration number is visible in the center window 42. The golfer then reads the weight placement for each of the four locations through windows 48, 50, 52, 53, as shown in the graphical representation 44 of the club head 28. The motion path description name is also conveniently shown along the outer edge 55 of the instruction wheel 26. For example, in FIG. 6, the instruction wheel 26 displays weight positioning for the "high" trajectory motion path configuration, i.e., the first configuration. In this configuration, two 10-gram weights are placed in the rear ports 96, 98 and two 2-gram weights are placed in the forward ports 102, 104 (FIG. 2). If another configuration is selected, the instruction wheel 26 depicts the corresponding weight distribution, as provided in Table 1, above.

Torque Wrench

Figure 7:
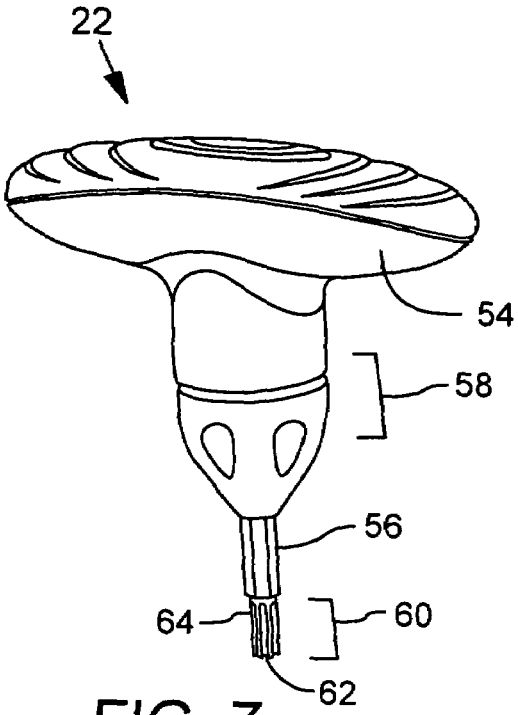
FIG. 7 is a perspective view of the tool of the kit of FIG. 1, depicting a grip and a tip.
Figure 8:
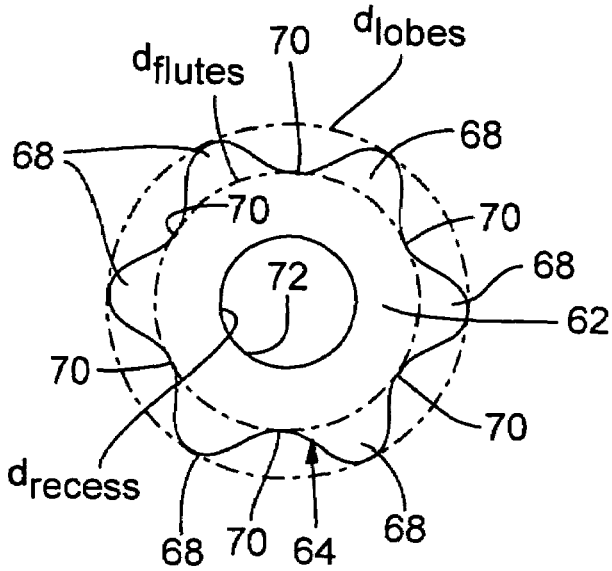
FIG. 8 is a close-up plan view of the tip of the tool of FIG. 7.

With reference now to FIGS. 7-8, the torque wrench 22 includes a grip 54, a shank 56, and a torque-limiting mechanism (not shown). The grip 54 and shank 56 generally form a T-shape; however, other configurations of wrenches can be used. The torque-limiting mechanism is disposed between the grip 54 and the shank 56, in an intermediate region 58, and is configured to prevent over-tightening of the weights 24 into the weight ports 96, 98, 102, and 104. In use, once the torque limit is met, the torque-limiting mechanism of the exemplary embodiment will cause the grip 54 to rotationally disengage from the shank 56. In this manner, the torque wrench 22 inhibits excessive torque on the weight 24 being tightened. Preferably, the wrench 22 is limited to between about twenty inch-lbs. and forty inch-lbs. of torque. More preferably, the limit is between twenty-seven inch-lbs and thirty-three inch-lbs of torque. In the exemplary embodiment, the wrench 22 is limited to about thirty inch-lbs. of torque. Of course, wrenches having various other types of torque-limiting mechanisms, or even without such mechanisms, can be used. However, if a torque-limiting mechanism is not used, care should be taken not to over-tighten the weights 24.

Figure 10:
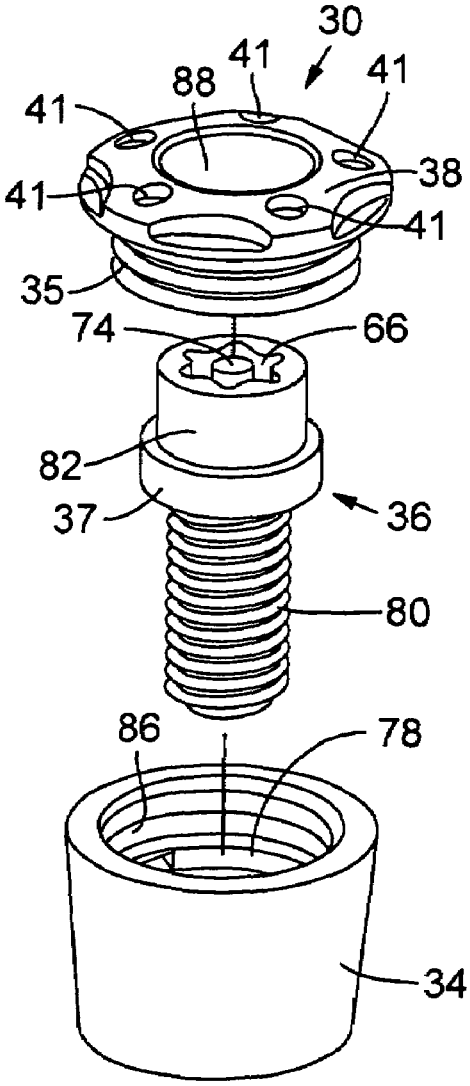
FIG. 10 is an exploded perspective view of a weight assembly of the kit of FIG. 1.
Figure 11:
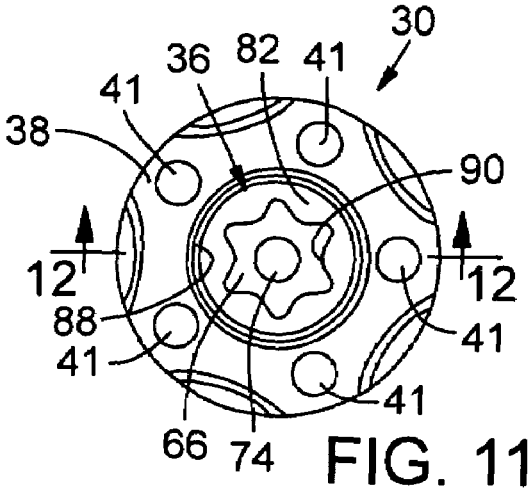
FIG. 11 is a top plan view of the weight assembly of FIG. 10.

The shank 56 terminates in an engagement end, i.e., tip 60, configured to operatively mate with the weight screws 32 and the weight assembly screws 36 (FIGS. 9-11). The tip 60 includes a bottom wall 62 and a circumferential side wall 64. As shown in FIGS. 9-11, the head of each of the weight screws 32 and weight assembly screws 36 defines a socket 124 and 66, respectively, having a complementary shape to mate with the tip 60. The side wall 64 of the tip 60 defines a plurality of lobes 68 and flutes 70 spaced about the circumference of the tip. The multi-lobular mating of the wrench 22 and the sockets 66 and 124 ensures smooth application of torque and minimizes damage to either device (e.g., stripping of tip 60 or sockets 66, 124). The bottom wall 62 of the tip 66 defines an axial recess 72 configured to receive a post 74 disposed in sockets 66 and 124. The recess 72 is cylindrical and is centered about a longitudinal axis of the shank 56.

With reference now to FIG. 8, the lobes 68 and flutes 70 are spaced equidistant about the tip 60, in an alternating pattern of six lobes and six flutes. Thus, adjacent lobes 68 are spaced about 60 degrees from each other about the circumference of the tip 60. In the exemplary embodiment, the tip 60 has an outer diameter ($d_{lobes}$), defined by the crests of the lobes 68, of about 4.50 mm, and trough diameter ($d_{flutes}$) defined by the troughs of the flutes 70, of about 3.30 mm. The axial recess has a diameter ($d_{recess}$) of about 1.10 mm. Each socket 66, 124 is formed in an alternating pattern of six lobes 90 that complement the six flutes 70 of the wrench tip 60.

Weights

Generally, as shown in FIGS. 1 and 9-12, weights 24, which in this implementation include weight assemblies 30 and weight screws 32, are non-destructively positionable about or within golf club head 28. In specific embodiments, the weights 24 can be attached to the club head 28, removed, and reattached to the club head without degrading or destroying the weights or the golf club head. In some embodiments, the weights 24 are accessible from an exterior of the golf club head 28.

In general, each of the weights 24 can include an outer end defined as an end of the weight proximate an exterior of the golf club head and an inner end defined as an end nearer an interior of the golf club than the outer end.

With reference now to FIG. 9, each weight screw 32 has a head 120, a body 122, a stop, or annular ledge 126, and a threaded portion 128. The weight screws 32 are preferably formed of titanium or stainless steel, and provide a weight with a low mass that can withstand forces endured upon impacting a golf ball with the club head 28. The combined masses of the head 120, body 122, stop 126 and threaded portion 128 can be defined as a total weight screw mass. The weight screw size, composition or combination of both can be varied to satisfy particular durability and mass requirements. For example, in some embodiments, the length of the weight screw 32 can be increased to increase the total weight screw mass. In other embodiments, the weight screw 32 can be formed of a heavier or more durable material to increase its mass or durability. In more specific embodiments, the size of the head 120, stop 126 and threaded portion 128 remain the same while adjustments to the length or width of the body are made to achieve an overall change to the total weight screw mass. For example, the body 122 can have a cross-sectional maximum dimension ($d_1$) that can be varied between about 4 mm and about 8 mm.

In some embodiments, the weight screw 32 can have an overall length ($L_1$) between about 18 mm and about 20 mm and a total mass between about 1 gram and about 5 grams. In one exemplary embodiment, the weight screw 32 has an overall length ($L_1$) of about 18.3 mm and a mass of about two grams. In another embodiment, the weight screw 32 has an overall length of about 19.5 mm and a mass of about 5 grams.

In the embodiment shown in FIG. 9, weight screw head 120 is sized to enclose the corresponding weight ports 96, 98, 102, 104 (FIGS. 2 and 5) of the club head 28, although this is not a requirement. In this way, a periphery of the weight screw head 120 generally abuts a side wall 106 of the ports, which helps prevent debris from entering the corresponding port. Preferably, the weight screw head 120 outer diameter ($d_3$) ranges between about 11 mm and about 13 mm, corresponding to weight port diameters of various exemplary embodiments. In specific embodiments, the outermost diameter ($d_3$) of the weight screw head 120 is between about 11 mm and about 12 mm or between about 12 mm and about 13 mm. In the illustrated embodiment, the weight screw head 120 has a diameter ($d_3$) of about 12.3 mm.

The weight screw head 120 defines a socket 124 having a multi-lobular configuration sized to operatively mate with the wrench tip 60. In some embodiments, the weight screw head 120 has an outer end surface that has a slightly domed shape. In other embodiments, the weight screw head outer end surface can include markings, such as markings corresponding to mass characteristics of the weight screw, e.g., the total mass of the weight screw 32. The markings may comprise text, colors, patterns or a combination thereof.

The annular ledge 126 is located in an intermediate region of the weight screw 32. The ledge 126 has a diameter ($d_2$) greater than that the diameter of the threaded openings 110 defined in the weight ports 96, 98, 102, 104 of the club head 28 (FIG. 2), thereby serving as a stop when the weight screw 32 is tightened. In the embodiment, the annular ledge 126 is a distance ($L_2$) of about 11.5 mm from an outer end of the weight screw head 120 and has a diameter ($d_2$) of about 6 mm. In other embodiments, the diameter ($d_2$) is approximately 8 mm. The threaded portion 128 is located below the annular ledge 126. In this embodiment, M5×0.6 threads (i.e., a thread outer diameter ($d_4$) of 5 mm and a thread pitch of 0.6) are used. The threaded portion 128 is configured to mate with the threaded openings 110 defined in the weight ports 96, 98, 102, 104 of the club head 28.

Figure 12:
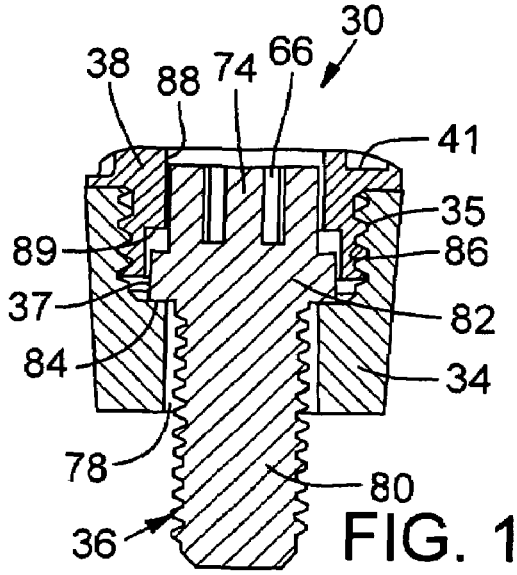
FIG. 12 is a cross-sectional view of the weight assembly of FIG. 10, taken along line 12-12 of FIG. 11.

With reference now to FIGS. 10-12, each mass element 34 of the weight assemblies 30 defines a bore 78 sized to freely receive the weight assembly screw 36 and at least a portion of the retaining element 38. As shown in FIG. 12, the bore 78 can be a stepped bore with a lower non-threaded portion and an upper threaded portion. An annular engagement surface, or shoulder 84, can be formed in the bore 78 where the upper portion transitions to the lower portion. The lower portion is sized sufficiently large to freely receive a weight assembly screw body 80 of screw 36, but not to allow the weight assembly screw head 82 to pass through the bore 78. The upper portion of the bore 78 is sufficiently sized to at least partially receive the weight assembly screw head 82. More particularly, in some embodiments, the weight assembly screw head 82 includes a peripheral rim 37 that rests upon the shoulder 84 formed in the bore 78 when the weight assembly 30 is retained in the golf club head 28.

The upper portion of the bore 78 can have internal threads 86 for securing the retaining element 38. In some embodiments, the internal threads 86 have an outer diameter of approximately 10 mm and a thread pitch of approximately 1.0.

In the illustrated embodiments, the peripheral rim 37 of the screw 36 has an outermost diameter of approximately 7.4 mm and a height of approximately 2 mm. The portion of the weight assembly screw head 82 extending from the peripheral rim 37 has a diameter of approximately 6 mm and a height of approximately 3.5 mm. The screw 36 is generally made from a steel.

To facilitate a press fit in a recess formed in a golf club head, in some embodiments, the mass element 34 is conical frustum shaped with an outer sidewall surface tapering at an angle of approximately 95 degrees relative to a surface of the outer end of the mass element 34.

In some embodiments, the outer end of the mass element 34 has an outermost diameter between about 11 mm and about 13 mm. In the illustrated embodiments, the mass element 34 has a generally circular cross-sectional shape in a plane perpendicular to its axis. In other embodiments, the mass element 34 can have a generally triangular, hexagonal, oval, rectangular or other cross-sectional shape.

The retaining element 38 is typically made from a steel alloy, such as a 300-series stainless steel, a hardened stainless steel such as 17-4H900, or a similar material. The retaining element 38 can define a bore 88 sized to allow access to the screw socket 66 as well as retaining the screw 36 within the upper portion of the bore 78. The bore 88 can be a stepped bore having an upper portion and a lower portion. In the illustrated embodiment, the upper portion has a first diameter and the lower portion has a second diameter that is larger than the first diameter. In specific embodiments, the first diameter is approximately 6.0 mm and the second diameter is approximately 8.0 mm. As used herein, the term "bore" in connection with bore 78 and bore 88 refers to any through opening and is not restricted to openings having a circular cross-section.

In some embodiments, an annular engagement surface, or shoulder 89, can be formed in the bore 88 where the upper portion transitions to the lower portion. The first diameter of the upper portion is smaller than the outermost diameter of the peripheral rim 37 of the assembly screw head 82 and larger than the diameter of the portion of the head extending from the peripheral rim 37. The retaining element 38 can include external threads 35 corresponding to the internal threads 86 of the upper portion of the bore 78. In some embodiments, the retaining element 38 has an outer end surface that is slightly domed in shape. In other embodiments, the retaining element outer end surface can include markings corresponding to mass characteristics of the weight assembly, e.g., a total mass of the weight assembly.

Figure 5:
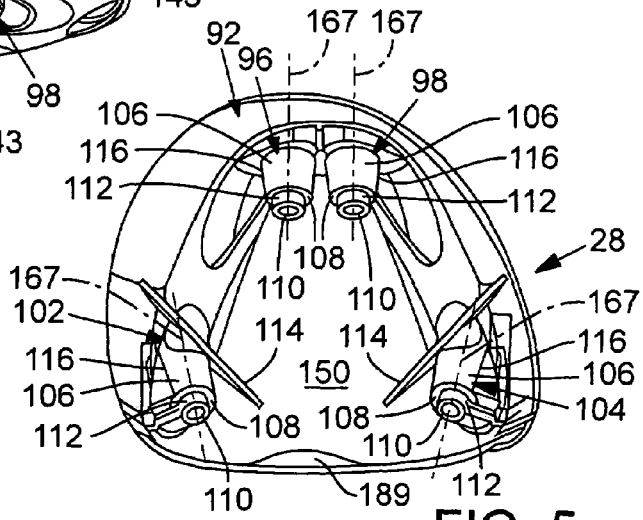
FIG. 5 is a cross-sectional view of the club head of FIG. 2, taken along line 5-5 of FIG. 4.

Similar to the weight screw head described above, the retaining element can have an outermost diameter sized such that a periphery of the retaining element 38 generally abuts the side wall 106 of the ports 96, 98, 102, 104 (FIGS. 2 and 5). In some embodiments, the retaining element outermost diameter is approximately equal to the mass element first end outermost diameter.

In assembling the weight assembly 30, the weight assembly screw 36 is inserted into the bore 78 of the mass element 34 such that the lower end of the weight assembly screw body 80 extends out the lower portion of the bore 78 and the weight assembly screw head 82 rests within the upper portion of the bore 78. The retaining element 38 is then coupled to the mass element 34 by threading the external threads 35 of the retaining element with the internal threads 86 of the mass element bore 78. In some embodiments, the outer end surface of the retaining element 38 includes tool receiving holes 41 or other features that engage a tool used to couple the retaining element 38 to the mass element 34. In certain embodiments, a thread locking compound can be used to secure the retaining element 38 to the mass element 34.

As shown in FIG. 12, the screw 36 is retained in the assembly 30 by capturing the peripheral rim 37 of the screw in a space between the mass element shoulder 84 and the retaining element shoulder 89. In other words, with the retaining element 38 in place, the screw 36 is allowed to rotate freely and move in the axial direction, but its axial movement in the inward direction is confined by engagement of the peripheral rim 37 with the shoulder 84 and its axial movement in the outward direction is confined by engagement of the peripheral rim 37 with the shoulder 89.

When assembled, the upper portion of the axial opening 88 exposes the socket 66 of the weight assembly screw head 82 and facilitates engagement of the wrench tip 60 in the socket 66 of the weight assembly screw 36. As mentioned above, the side wall of the socket 66 defines six lobes 90 that conform to the flutes 70 (FIG. 8) of the wrench tip 60. The cylindrical post 74 of the socket 66 is centered about the longitudinal axis of the screw 36. The post 74 is received in the axial recess 72 (FIG. 8) of the wrench 22. The post 74 facilitates proper mating of the wrench 22 and the weight assembly screw 36, as well as inhibiting use of non-compliant tools, such as Phillips screwdrivers, Allen wrenches, and so on.

Club Head

As illustrated in FIGS. 2-5, a golf club head 28 of the present application includes a body 92. The body 92 can include a crown 141, sole 143, skirt 145 and face plate 148 defining an interior cavity 150. The body further includes a heel portion 151, toe portion 153 and rear portion 155.

The crown 141 includes an upper portion of the golf club head 28 above a peripheral outline of the head and top of the face plate 148.

The sole 143 includes a lower portion of the golf club head 28 extending upwards from a lowest point of the club head when the club head is ideally positioned, i.e., at a proper address position. For a typical driver, the sole 143 extends upwards approximately 15 mm above the lowest point when the club head is ideally positioned. For a typical fairway wood, the sole 143 extends upwards approximately 10 mm to about 12 mm above the lowest point when the club head is ideally positioned. A golf club head, such as the club head 28, can be ideally positioned when angle 163 measured between a plane tangent to the an ideal impact location on the face plate and a perfectly vertical plane relative to the ground is approximately equal to the golf club head loft and when the golf club head lie angle is approximately equal to an angle between a longitudinal axis of the hosel or shaft and the ground 161. The ideal impact location is disposed at the geometric center of the face plate. The sole 143 can also include a localized zone 189 proximate the face plate 148 having a thickness between about 1 mm and 3 mm, and extending rearwardly away from the face plate a distance greater than about 5 mm.

The skirt 145 includes a side portion of the golf club between the crown and the sole that extends across a periphery of the golf club head, excluding the face plate, from the toe portion 153, around the rear portion 155, to the heel portion 151.

The crown, sole and skirt can be integrally formed using techniques such as molding, cold forming, casting, and/or forging and the face plate can be attached to the crown, sole and skirt by means known in the art. Furthermore, the body can be made from a titanium and/or steel alloy, composite material, ceramic material, or any combination thereof.

With reference again to FIGS. 2-5, the club head 28 can include a thin-walled body 92 and a face plate 148.

The weights 24 of the present application can be accessible from the exterior of the club head 28 and securely received into the weight ports 96, 98, 102, and 104. Weight ports can be generally described as a structure coupled to the golf club head crown, golf club head skirt, golf club head sole or any combination thereof that defines a recess, cavity or hole on, about or within the golf club head. The four ports 96, 98, 102, and 104 of the club head 28 are positioned low about periphery of the body 92, providing a low center of gravity and a high moment of inertia. More particularly, first and second recesses 96, 98 are located in a rear portion 155 of the club head 28, and the third and fourth recesses 102 and 104 are located in a toe portion 154 and a heel portion 152 of the club head 28, respectively. Fewer, such as two or three weights, or more than four weights may be provided as desired.

The ports 96, 98, 102, and 104 are each defined by a port wall 106 defining a weight cavity 116 and a port bottom 108. In embodiments of a weight having a mass element with tapered outer surfaces, the port wall 106 is correspondingly tapered to receive and secure the mass element in place via a press fit. The port bottom 108 defines a threaded opening 110 for attachment of the weights 24. The threaded opening 110 is configured to receive and secure the threaded portion of the weight assembly screw body 80 and weight screw threaded portion 128. In this embodiment, the threaded bodies 80 and 128 of the weight assembly 30 and weight screw 32, respectively, have M5×0.6 threads. In other embodiments, the thread pitch is about 0.8. The threaded opening 110 may be further defined by a boss 112 extending either inward or outward relative to the weight cavity 116. Preferably, the boss 112 has a length at least half the length of the body 80 of the weight assembly screw 36 and, more preferably, the boss 112 has a length 1.5 times a diameter of the body of the screw. As depicted in FIG. 5, the boss 112 extends outward, relative to the weight cavity 116 and includes internal threads (not shown). Alternatively, the threaded opening 110 may be formed without a boss 112. The ports have a weight port radial axis 167 defined as a longitudinal axis passing through a volumetric centroid, i.e., the center of mass or center of gravity, of the weight port.

As depicted in FIG. 5, the club head 28 can include fins 114 disposed about the forward weight ports 102 and 104, to provide support within the club head and reduce stresses on the golf club head walls during impact with a golf ball. In this embodiment, the club head 28 has a volume of about 460 cc and a total mass of about 200 grams, of which the face plate 148 accounts for about 24 grams. As depicted in FIG. 2, the club head 28 is weighted in accordance with the first configuration (i.e., "high") of Table 1, above. With this arrangement, a moment of inertia about a vertical axis at a center of gravity of the club head 28, $I_{zz}$, is about 405 kg-mm$^2$. Various other designs of club heads and weights may be used, such as those disclosed in above-referenced U.S. Pat. No. 6,773,360. Furthermore, other club head designs known in the art can be adapted to take advantage of features of the present invention.

To attach a weight assembly, such as weight assembly 30, in a port of a golf club head, such as the club head 28, the threaded portion of the weight assembly screw body 80 is aligned with the threaded opening 110 of the port. With the tip 60 of the wrench 22 inserted through the aperture 88 of the retaining element 38 and engaged in the socket 66 of the weight assembly screw 36, the user rotates the wrench to screw the weight assembly 30 in place. Torque from the engagement of the weight assembly screw 36 provides a press fit of the mass element 34 to the port. As sides of the mass element 34 slide tightly against the port wall 106, the torque limiting mechanism of the wrench 22 prevents over-tightening of the weight assembly 30.

Weight assemblies 30 are also configured for easy removal, if desired. To remove, the user mates the wrench 22 with the weight assembly 30 and unscrews it from a club head. As the user turns the wrench 22, the head 82 of the weight assembly screw 36 applies an outward force on the shoulder 89 of the retaining element 38, thereby extracting the mass element 34 from the weight cavity 116. In some embodiments, a low friction material, such as PTFE or similar material, can be provided on surfaces of the retaining element 38 and the mass element 34 to facilitate free rotation of the head 82 of the weight assembly screw 36 with respect to the retaining element 38 and the mass element 34.

Similarly, a weight screw, such as weight screws 32, can be attached to the body through a port by aligning the threaded portion of weight 32 with the threaded opening 110 of the port. The tip of the wrench can be used to engage the socket of the weight by rotating the wrench to screw the weight in place.

Alternative Movable Weight Embodiments

1. Weight Plug with Seal

Figure 13A:
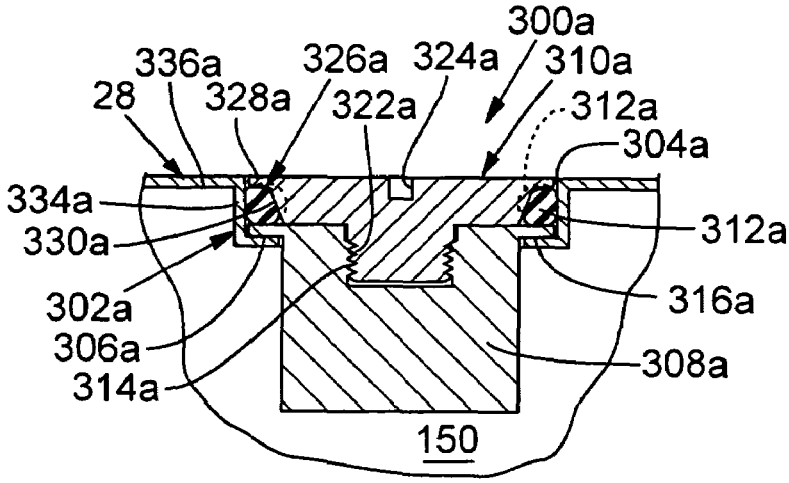
FIG. 13*a* is a cross-sectional view of an alternative weight plug shown installed in a recess formed in a golf club head.
Figure 13B:
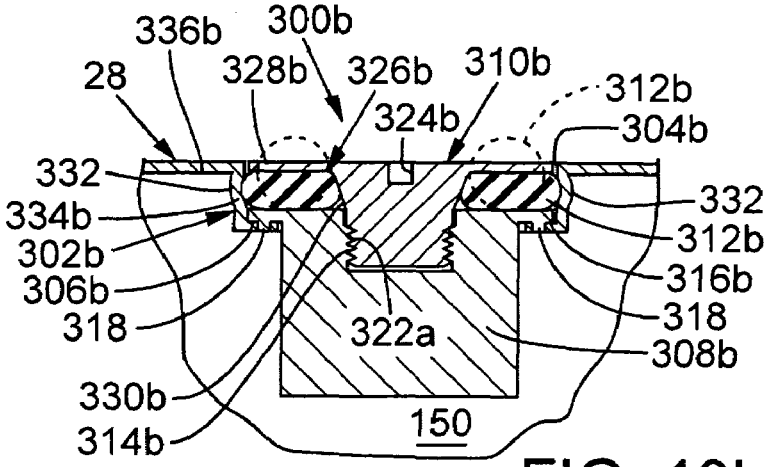
FIG. 13*b* is a cross-sectional view of an alternative weight plug shown installed in a recess formed in a golf club head.

Now with reference to FIGS. 13*a* and 13*b*, in some embodiments, the weights of the present application can be movable weight plugs 300*a*, 300*b* configured to be received in one or more recesses, e.g., recesses 302*a*, 302*b*, respectively, formed in the golf club head 28. Movable weight plugs 300*a*, 300*b* can be advantageous because they can be secured to a golf club head without the need of a weight port as described above. Golf club head designs without weight ports tend to have a greater proportion of discretionary weight that can then be distributed around the golf club head in the form of additional weights and/or higher weight masses than golf club head designs with ports. Recesses 302*a*, 302*b* have a less complex structure than ports, which leads to simpler and easier golf club head manufacturing processes, including casting or forging. Further, the illustrated recesses 302*a*, 302*b* do not include a threaded portion and therefore no tapping of threads is required to be performed in the golf club head 28.

With reference to FIG. 13*a*, the weight plug 300*a* and its corresponding recess 302*a* are described. The same description applies to the weight plug 300*b* and recess 302*b*, with like elements having the same reference numeral except with a "b" suffix instead of an "a" suffix, except for specific differences as noted.

Recess 302*a* defines a generally circular stepped bore 304*a* formed in the golf club head 28. The recess 302*a* includes a sidewall 334*a* extending between a first end of the bore that is generally flush with an outer surface of the golf club head 28 and a second end that is within the interior cavity 150 of the golf club head 28. The bore 304*a* defines a first diameter at its first end and a second diameter smaller than the first diameter at its second end. At the location where the first diameter transitions to the second diameter, recess 302*a* has a shoulder 306*a* configured to at least partially support the movable weight plug 300*a* during installation of the weight plug to the golf club head 28. In general, bore 306*a* includes a first segment between its first end and the shoulder 306*a* and a second segment between its second end and the shoulder 306*a*. In some embodiments, the recess sidewall 334*a* is seamlessly integrated with the golf club head wall 336*a* and can have a thickness equal to the thickness of the golf club head wall 336*a*.

As shown in FIG. 13*a*, movable weight plug 300*a* can include a mass element 308*a*, weight cap 310*a* and seal, such as o-ring 312*a*. As used herein, the term "o-ring" can include an o-ring, or similar structure for effecting a seal, made of any suitable elastomeric material, such as, but not limited to, artificial and natural rubbers, including, but not limited to, polyacrylate, ethylene acrylic, butyl, neoprene, ethylene propylene, fluorosilicone, nitrile, polyurethane, silicone, and other such materials as are commonly known in the art.

The mass element 308*a* has a first end positioned as shown closer to the exterior of the golf club head 28 and a second end positioned as shown nearer the interior of the golf club head than the first end, when the weight plug 300*a* is secured in recess 302*a*. The first end can include a threaded portion, such as threaded hole 314*a* and a peripheral rim 316*a* extending circumferentially around the mass element 308*a*. Although in the illustrated embodiment the first end includes a threaded portion, in other embodiments, the first end can include a fastening arrangement of a different type.

In embodiments with a generally circular mass element, the peripheral rims 316*a* can have an outermost diameter that is greater than an outermost diameter of the portion of the mass element extending from the peripheral rim 316*a*. The peripheral rim 316*a* is sized such that an inner surface of the peripheral rim 316*a* engages the shoulder 306*a* formed in recess 302*a* such that the peripheral rim is positioned within the second segment of the stepped bore 304*a*. In this way, the shoulder 306*a* at least partially supports the mass element 308*a* during installation of the weight plug 300*a* in the recess 302*a*. The portion of the mass element 308*a* extending from the peripheral rim 316*a* to the second end is sized to extend beyond the shoulder 306*a* and the second segment of the bore 304*a*.

Because the second end of the mass element 308*a* need not be accommodated within a recess formed in the golf club head 28 of a fixed size, the mass of the mass element 308*a* can be easily increased or decreased by increasing or decreasing the length of the mass element 308*a* without adjusting the configuration of the golf club head 28 or recesses formed therein. Therefore, the mass of the weight plug 300*a* can be changed by changing the length of the mass element 308*a* without the need to adjust the recess 302*a* or other components of the golf club head 28.

As shown in FIG. 13*b*, the inner surface of the peripheral rim 316*b* is different than the inner surface of peripheral rim 316*a* in that the inner surface peripheral rim 316*b* includes tabs 318 configured to mate with corresponding holes 320 formed in the shoulder 306*b*. When the weight plug 300*b* is installed in the recess 306*b*, the tabs 318 help to restrict rotation of the weight plug 300*b* about its axis.

The weight cap 310*a* is configured generally to cause the o-ring 312*a* to frictionally engage an inner surface of the recess 302*a* as the cap 310*a* is tightened to the mass element 308*a*. In several embodiments, the cap 310*a* is generally disk shaped with an outer end proximate the exterior of the golf club head 28 and an inner end nearer the interior of the golf club head than the outer end when the weight plug 300*a* is installed in the recess 302*a*. The outer end can have a diameter approximately equal to the first diameter of the recess bore 304*a*. In some embodiments, the weight plug 300*a* is configured such that the outer surface of the cap 310*a* is approximately flush with an outer surface of the golf club head when the weight plug 300*a* is installed in the recess 302*a*.

The weight cap 310*a* can include a threaded portion corresponding to the mass element threaded portion 314*a* that extends from the inner end of the cap. In some embodiments, the threaded portion is an externally threaded protrusion 322*a* configured to mate with the threaded hole 314*a* formed in the mass element 308*a*. The weight cap can also include at least one socket 324*a* that is designed to receive a mating end of a tool for tightening the cap 310*a* to the mass element 308*a*. For example, the socket 324*a* can be a slot for engagement with a flat-head screwdriver or a multi-lobular socket that mates with a multi-lobular tool, such as torque wrench 22.

The cap 310*a* can also include an o-ring retention groove 326*a* formed generally around the circumference of the cap 310*a*. In several embodiments, the retention groove 326*a* includes a ceiling surface 328*a* and a tapered surface 330*a*. The ceiling surface 328*a* runs generally parallel to the outer surface of the cap 310*a* and has an outer diameter approximately equal to the outer end diameter of the cap 310*a*. The tapered surface 330*a* tapers in a direction from the outer end to the inner end of the cap 310*a*.

The o-ring 312*a* is positioned between the mass element 308*a* and the cap 310*a* when the weight plug 300*a* is assembled. In general, prior to assembly, the o-ring 312*a* is positioned and rests on the first end of the mass element in an undeformed state (indicated by dashed lines). The cap 310*a* is positioned such that the threaded portion of the cap 310*a* extends through the o-ring 312*a* and is rotated until threaded engagement between the cap 310*a* and the mass element 308*a* is initiated.

As the cap 310*a* is tightened, it travels in an axially inward direction toward the interior of the golf club head 28 and comes in contact with the o-ring 312*a*. Pressure is applied on the o-ring which causes the o-ring to deform at least partially in the radially outward direction. The tapered surface 330*a* and the ceiling 328*a* of retention groove 326*a* facilitate the radially outward directed deformation of the o-ring 312*a*. Tightening of the cap 310*a* causes the o-ring 312*a* to deform and substantially fill a volume defined by the outer surface of the recess 302*a* the o-ring retention groove 326*a* and the first end of the mass element 308*a*. The portion of the o-ring 312*a* in contact with the outer surface of the recess 302*a* applies a radially outward directed pressure on the outer surface of the recess 302*a* which results in a frictional resistance to movement of the weight plug 300*a* in the axial direction. In this way, the weight plug 300*a* is retained in the recess 302*a*. Additionally, with the o-ring 312*a* applying a radially outward directed pressure on the recess 302*a*, the o-ring 312*a* is able to assist in preventing water, and other debris, from entering the golf club head 28 through the recess 302*a*.

Frictional resistance to movement of the weight plug 300*a* is a function of the magnitude of the radially outward directed pressure applied on the outer surface of the recess 302*a* by the o-ring 312*a* and the amount of outer surface area contacted by the o-ring. Therefore, the cap and mass element threaded portions, and the o-ring, can be configured such that a sufficient frictional resistance to retain the weight plug 300*a* in the recess 302*a* is achieved when the cap 310*a* is fully tightened to the mass element 308*a*. Further, shoulder 306*a* may engage peripheral rim 316*a* to provide additional support to weight plug 300*a* after installation.

In some embodiments, the ceiling surface 328*a* can also provide frictional resistance to movement of the o-ring 312*a* from the deformed to the undeformed state, thereby helping to ensure consistent contact between the o-ring 312*a* and the inner surface of the recess 302*a*.

In the illustrated embodiment shown in FIG. 13*b*, the cap 310*b* is different than the cap 310*a* of FIG. 13*a* in that cap 310*b* has a ceiling surface 328*b* with a larger surface area than the ceiling surface 328*a* of the embodiment shown in FIG. 13*a* can be used. In this embodiment, the o-ring 312*b* has a larger cross-sectional diameter than the o-ring 312*a* in FIG. 13*a* when in the undeformed state (indicated by dashed lines) and can be used to increase frictional resistance to movement towards an undeformed state when the cap 310*b* is fully tightened to the mass element 308*b*.

In some embodiments, as shown in FIG. 13*b*, the recess 302*b* is slightly different than the recess 302*a* in that a recess groove 332 can be formed in the outer surface of the sidewall 334*b* of the first segment of the recess 302*b*. As the o-ring 312*b* deforms, it expands into the recess groove 332, making axial movement of the weight plug 300*b* more difficult by increasing frictional resistance to movement of the o-ring 312*b*, and thus the weight plug 300*b*, in the axial direction.

In the embodiments shown in FIGS. 13*a* and 13*b*, the weight plugs 300*a* and 300*b* are configured to facilitate removal of the cap 310*a*. For example, as the cap 310*a* is released from the mass element 308*a*, the o-ring 312*a* being biased toward an undeformed state retracts in the radially inward direction and causes the cap to protrude beyond the outer surface of the golf club head facilitating removal of the cap 310*a*. The removal of cap 310*b* can be facilitated in the same way.

Although the illustrated embodiments of the present application show an o-ring with a generally circular cross-section, o-rings having any of various cross-sections, such as rectangular, elliptical, or other cross-sections, can be used. Furthermore, while the illustrated embodiments of FIGS. 13*a* and 13*b* show o-rings 312*a*, 312*b*, other deformable seals can also be used.

2. Interlocking Weight Plug

As shown in FIGS. 14*a*-14*e*, in some embodiments, the weights can be interlocking weight plugs 350 configured to be received in one or more recesses, e.g., recess 352, formed in the golf club head 28. Interlocking weight plug 350 and recess 352 provide at least the same advantages as the weight plugs 300*a*, 300*b* and the recesses 302*a*, 302*b*, respectively, as described above in relation to FIGS. 13*a* and 13*b*, and additional advantages as will be apparent in view of the following description.

Referring to FIGS. 14*b*-14*e*, like the recesses 302*a*, 302*b*, recess 352 defines a stepped bore 353 with a first end that is generally flush with an outer surface of the golf club head 28, a second end that is within the interior cavity 150 if the golf club head 28. The recess 352 includes a sidewall 356 extending between the first end and the second end of the bore 353. However, unlike recesses 302*a*, 302*b*, only a portion of the stepped bore 353 of recess 352 is generally circularly shaped. For example, in the illustrated embodiment, the first end of the bore 353 defines an outer opening 358 having a generally circular shape defining a diameter and the second end of the bore 353 defines an inner opening 360 having a generally elliptical shape with a major axis and a minor axis. The major axis of the inner opening 360 is equal to or less than the first diameter of the outer opening 358.

The bore 353 of recess 352 includes a first segment extending from the first end and a second segment extending from the second end. The first segment has the same cross-sectional shape in a plane perpendicular to the recess axis as the outer opening 358 and the second segment has the same cross-sectional shape in a plane perpendicular to the recess axis as the inner opening 360. At a location where the first segment transitions to the second segment, the recess 352 has a shoulder 362 configured to at least partially support the interlocking weight plug 350 when installed in the golf club head 28. As with recesses 302*a*, 302*b*, in some embodiments, the recess sidewall 356 is seamlessly integrated with the golf club head wall 364 and can have a thickness equal to the thickness of the golf club head wall 364.

Figure 14B:
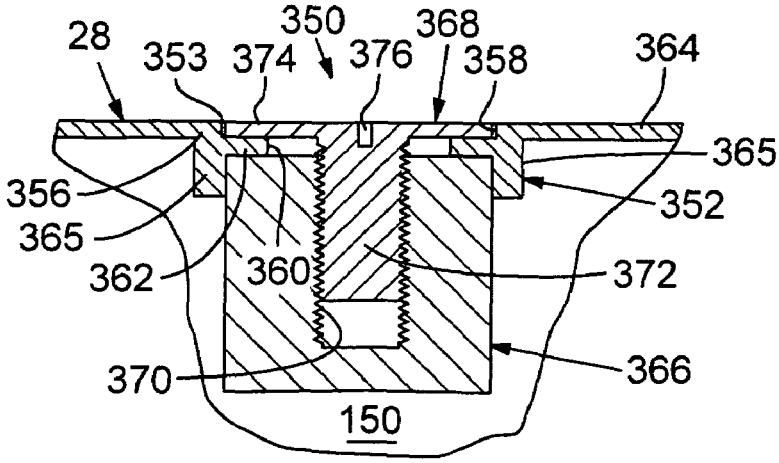
FIG. 14*b* is a cross-sectional view of an interlocking weight plug shown installed in a recess formed in a golf club head, taken along line 14*b*-14*b* of FIG. 14*e*.
Figure 14A:
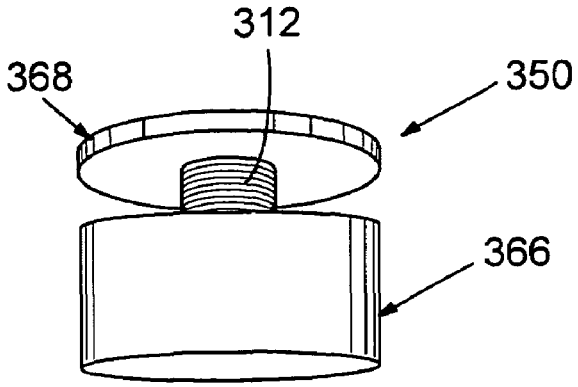
FIG. 14*a* is perspective view of an interlocking weight plug according to one embodiment.
Figure 14C:
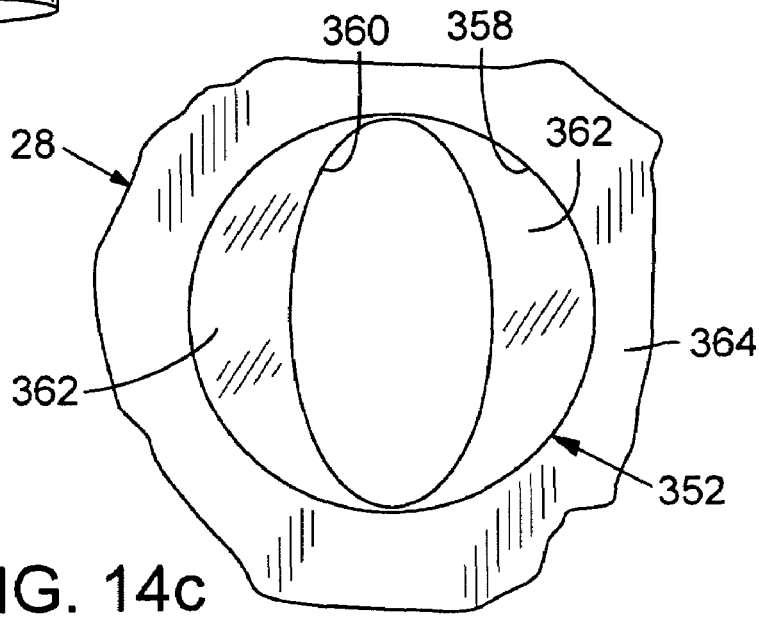
FIG. 14*c* is a top plan view of the recess of FIG. 14*b* shown from a position external to the golf club head and without the interlocking weight plug installed.
Figure 14D:
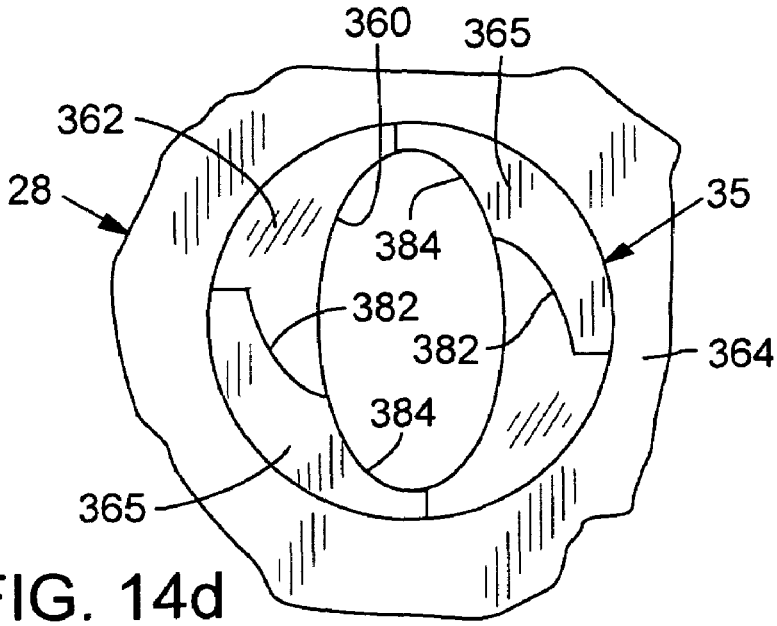
FIG. 14*d* is a bottom plan view of the recess of FIG. 14*b* shown from a position within the golf club head and without the interlocking weight plug installed.

As particularly shown in FIG. 14*d*, recess 352 can also includes at least one stop 365 extending from the recess proximate the second end of the stepped bore 353 towards the interior cavity 150. The stop 365 is configured to limit rotation of the mass element 366 when the mass element is positioned within the recess 352 and extends through the second opening 360. In the illustrated embodiments, the recess 352 includes two stops 365 positioned on opposite sides of the recess and that limit the range of rotation of the mass element 366 to approximately 90 degrees.

Referring to FIGS. 14*a* and 14*b*, interlocking weight plug 350 can include a mass element 366 coupled to a cap 368.

The mass element 366 includes a generally elongate member with a cross-section that corresponds with the shape of the opening 360. In some embodiments, the shape of the mass element cross-section is approximately the same as the opening 360. In the illustrated embodiment, the cross-section is generally elliptically shaped, although in other embodiments, the mass element 366 cross-section can be other non-circular shapes, such as, but not limited to, squares, rectangles and polygons. Accordingly, the mass element 366 is sized to extend through the opening 360 beyond the second end of the recess 352.

As with the second end of the mass elements 308*a*, 308*b*, the second end of the mass element 366 need not be accommodated within a recess formed in the golf club head of a fixed size. Consequently, the mass of the weight plug 350 can be changed without reconfiguring the recess 352, cap 368, or other component of the golf club head 28 by simply increasing or decreasing the length of the mass element 366.

The mass element 366 has a first end and a second end. The first end is positioned as shown closer to the exterior of the golf club head 28 than the second end, and the second end is positioned as shown nearer the interior of the golf club head than the first end, when the weight plug 350 is secured in weight recess 352 (see FIG. 14*a*). The mass element 366 includes a mating portion 370 extending from the first end toward the second end. The mating portion 370 is configured to receive a corresponding mating portion 372 formed in the cap 368. In the illustrated embodiment, the mating portion 370 is a hole having internal threads and the mating portion 372 is an elongated cylinder having external threads that correspond to the internal threads of the hole. Although the mating portions 370 and 372 are complimenting threaded portions, in other embodiments, the mating portions can have other configurations providing for mating engagement.

The cap 368 includes the mating portion 372, as described above, a recess cover 374 and at least one socket 376. The mating portion 372 is attached to the cover 374 at one end and extends inward generally perpendicular to the cover 374. The cover 374 is generally circularly shaped with a diameter approximately equal to the diameter of recess opening 358 as shown in FIG. 14*b*. The cover 374 is configured to fit within the first segment of the stepped bore 353 and rest on the recess shoulder 362. In some embodiments, the cover can have a thickness such that when weigh plug 350 is secured within the recess 352, an outer surface of the cover 374 is flush with the outer surface of the golf club head 28.

The cap 368 also includes at least one socket 376, extending inward from the outer surface of the cap 368. The socket 376 is configured to receive a mating end of a tool for tightening the cap 368 to the mass element 308*a*. For example, the socket 376 can be a slot for engagement with a flat-head screwdriver or a multi-lobular socket that mates with a multi-lobular tool, such as torque wrench 22.

In use, the interlocking weight plug 350 is oriented such that the mass element 366 aligns with the recess inner opening 360 and the cap 368 aligns with the recess outer opening 358. The weight plug 350 is then inserted into the recess 352 such that the mass element 366 extends through and beyond the recess opening 360 and the cap cover 374 rests on the recess shoulder 362. In some embodiments, a mating end of a tool, such as torque wrench 22, is inserted into the at least one socket 376 and the tool is rotated in a tightening direction, which is typically a clockwise direction as shown by directional arrows 380 of FIG. 14*e*. Rotating the tool in the tightening direction correspondingly rotates the cap 368 and the mass element 366 coupled to the cap 368 until the mass element 366 contacts the stop 365. In some embodiments, as shown in FIG. 14*b*, the cap 368 and mass element 366 are rotated approximately 90 degrees from the position of the mass element 366 after initial insertion through the opening 360 before the mass element 366 contacts the stop 365.

With the stop 365 preventing further rotation of the mass element 366 in the tightening direction, additional rotation of the tool in the tightening direction rotates the cap 368 relative to the mass element 366 such that the mating portion 372 of the cap 368 further engages the mating portion 372 of the mass element 366 to tighten the cap to the mass element. Tightening the cap 368 to the mass element 366 results in the cap 368 and the mass element 366 moving relative to each other in the axial direction such that the distance between the cap cover 374 and the first end of the mass element 366 is reduced. The cap 368 and the mass element 366 continue to move relative to each other as the cap 368 is further tightened to the mass element 366 until a portion of the first end of the mass element 366 applies an outward directed pressure to an inner surface of the recess shoulder 360 and a portion of the cap cover 374 applies an inward directed pressure to an outer surface of the shoulder 362. In general, the outward directed pressure and the inward directed pressure are opposing pressure having approximately the same magnitude. Any additional rotation of the tool in the tightening rotation increases the respective pressures until the interlocking weight plug 350 is secured in the recess 352, i.e., until the weight plug 350 is locked.

The weight plug 350 can be removed, or unlocked, by mating the tool with the at least one socket 376 and rotating the tool in a loosening direction, which is typically a counterclockwise direction or a direction opposite the tightening direction. As the cap 368 rotates in the loosening direction, the cap 368 and the mass element 366 move relative to each other in the axial direction such that the distance between the cap cover 374 and the first end of the mass element 366 increases and the respective applied pressures to the recess shoulder 362 are reduced. Additional rotation of the cap 368 in the loosening direction correspondingly rotates the mass element 366 in the loosening direction until the mass element 366 is aligned with the inner opening 360. Upon proper alignment between the mass element 366 and the inner opening 360, the mass element is permitted to exit outward past the inner opening such that the weight plug 350 can be removed from the golf club head 28.

Figure 14E:
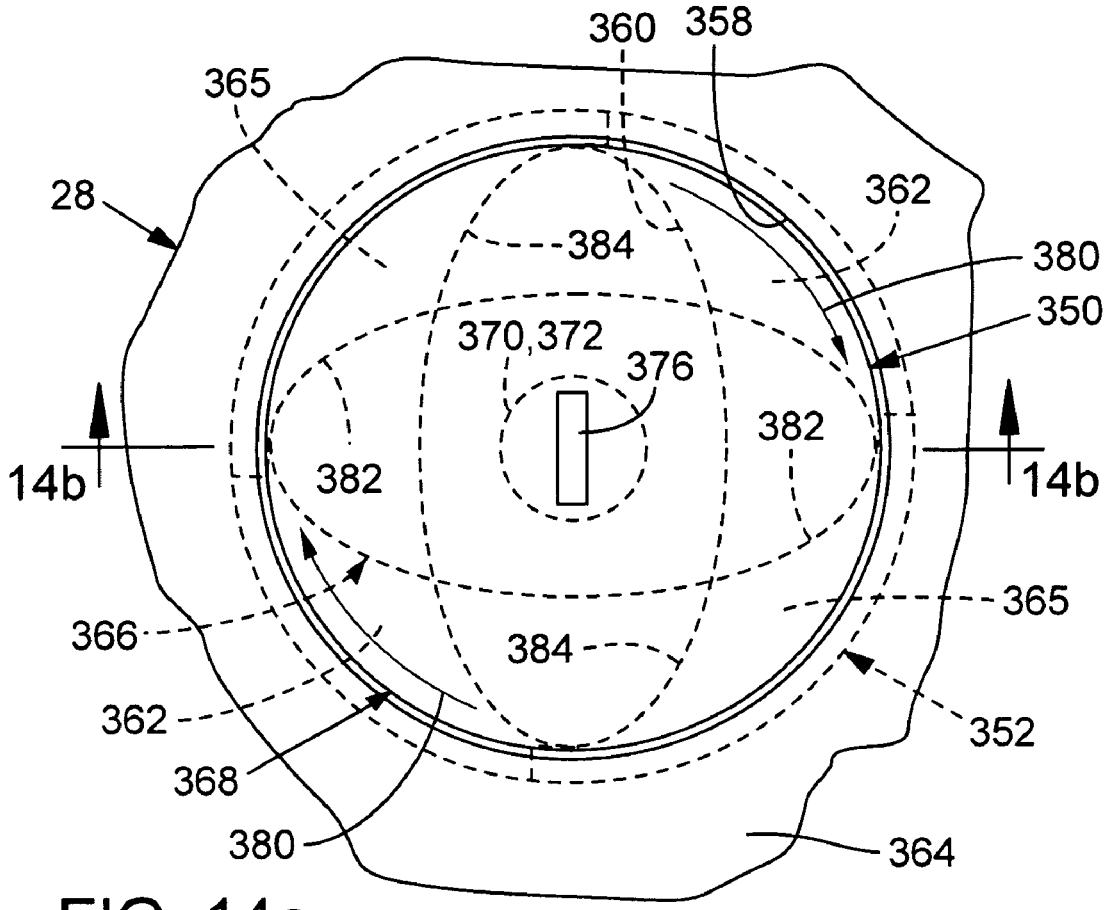
FIG. 14*e* is a top plan view of the interlocking weight plug of FIG. 14*a* shown installed in the recess of FIG. 14*b*.

In some embodiments, such as shown in FIGS. 14*d* and 14*e*, the recess stop 352 can be configured to assist in aligning the mass element 366 with the inner opening 360 by limiting rotation of the mass element in the loosening direction. To facilitate removing the weight plug 350, the mass element 366 can be rotated in the loosening direction until its rotation is restricted by contacting the stop 352. In this position, the mass element is in alignment with the inner opening 360 of the recess 352 and can be removed therethrough.

In some embodiments, such as shown, each stop 365 includes at least one mass element mating surface that is contoured to matingly receive a portion of the mass element 366. For example, in the illustrated embodiments, each stop 365 includes (i) a first mass element mating surface 382 having a curved contour that matingly engages a portion of the mass element 366 to stop the mass element as the mass element is turned in the tightening direction and (ii) a second mass element mating surface 384 having a curved contour that matingly engages another portion of the mass element to stop the mass element as the mass element is turned in the loosening direction.

In view of the many possible embodiments to which the principles of the disclosed movable weights may be applied, it should be recognized that the illustrated embodiments are only preferred examples and should not be taken as limiting the scope of the invention. Rather, the scope of the invention is defined by the following claims. We therefore claim as our invention all that comes within the scope and spirit of these claims.

I claim:

1. A movable weight plug configured for insertion into a recess formed in a golf club head comprising:

a mass element having a first end with a threaded portion and a second end extendable into and through the recess;

a seal positionable within the recess adjacent the first end of the mass element; and a cap having a seal retention portion configured to engage the seal, the cap further being configured to engage the threaded portion of the mass element to removably secure the mass element, seal and cap to the golf club head, wherein the cap has an outer end, an inner end, and a surface that tapers in a direction from the outer end to the inner end.

2. The movable weight plug of claim 1, wherein the cap and mass element are shaped to cause the seal to deform in a radially outward direction when the cap is moved closer to the mass element.

3. The movable weight plug of claim 2, wherein deformation of the seal assists in retaining the weight plug in the recess formed in the golf club head.

4. The movable weight plug of claim 2, wherein the deforming seal applies a radially outward directed pressure on a recess formed in the golf club thereby retaining the movable weight plug in the recess.

5. The movable weight plug of claim 4, wherein the seal is deformable into a groove formed in an inner wall of the recess.

6. The movable weight plug of claim 1, wherein the tapering surface applies a radially outward directed pressure on the seal when the cap is moved closer to the mass element.

7. The movable weight plug of claim 6, wherein the tapering surface of the cap has a first end having a first diameter and a second end having a second diameter smaller than the first diameter.

8. The movable weight plug of claim 7, wherein the seal has an inner diameter smaller than the first diameter of the tapered section when the seal is in an undeformed state.

9. The movable weight plug of claim 1, wherein the seal retention portion includes an upper lip having a diameter approximately equal to a recess diameter of the golf club head, the upper lip configured to restrict deformation of the seal in the axial direction as the cap engages the mass element.

10. The movable weight plug of claim 1, wherein the second end of the mass element is sized to extend into a recess formed in the golf club head and the first end comprises a lip configured to engage a portion of the recess to restrict the first end from passing through the recess such that the first end rests at least partially within the recess.

11. The movable weight plug of claim 1, wherein the mass element includes at least one retention tab configured to engage a corresponding retention hole formed in the recess of the golf club, the at least one retention tab restricting rotation of the weight plug while secured in the recess.

12. The movable weight plug of claim 1, wherein the cap includes an outer major surface that is substantially flush with an outer surface of the golf club head when the weight plug is secured in a recess formed in the golf club head.

13. The movable weight plug of claim 1, wherein the cap includes an outer major surface having a socket configured for engagement with a tool for securing the weight plug in the golf club head.

14. The movable weight plug of claim 1, wherein the cap can be tightened against the mass element such that the seal provides resistance to water entering the golf club head.

15. A method of securing a movable weight plug in a recess formed in a golf club head comprising:

inserting a mass element having a first end with a threaded portion and a second end into the recess such that the second end extends through the recess and the first end rests at least partially within the recess;

positioning a seal within the recess such that the seal rests on the first end of the mass element;

threadably engaging the mass element with a weight cap configured to engage the threaded portion of the mass element such that an seal retention portion formed in the weight cap urges the seal radially outward to frictionally engage an adjacent surface of the recess, wherein the recess includes a mass element receiving ledge and the mass element includes a support rim extending circumferentially around the first end of the mass element, and wherein inserting the mass element comprises resting the support rim on the mass element receiving ledge.

16. The method of claim 15, wherein threadably engaging the mass element with the weight cap causes the seal to deform in the radially outward direction.

17. The method of claim 15, wherein the surface of the recess includes a groove, and wherein threadably engaging comprises urging the seal radially outward to frictionally engage the groove in the adjacent surface of the recess.

18. The method of claim 15, wherein threadably engaging comprises tightening the weight cap against the mass element such that an outer surface of the weight cap is substantially flush with an outer surface of the golf club head.

19. The method of claim 15, wherein the weight cap includes an outer major surface having a socket configured for engagement with a tool for securing the weight plug in the recess of the golf club head, wherein threadably engaging comprising tightening the weight cap against the mass element by engaging the socket with the tool.

* * * * *